US005922665A

United States Patent [19]

Liu

[11] Patent Number: 5,922,665

[45] Date of Patent: Jul. 13, 1999

[54] AQUEOUS CLEANING COMPOSITION INCLUDING A NONIONIC SURFACTANT AND A VERY SLIGHTLY WATER-SOLUBLE ORGANIC SOLVENT SUITABLE FOR HYDROPHOBIC SOIL REMOVAL

[75] Inventor: Augustine Liu, Bloomington, Minn.

[73] Assignee: Minnesota Mining and Manufacturing Company, Saint Paul, Minn.

[21] Appl. No.: 08/864,149

[22] Filed: May 28, 1997

[51] Int. Cl.[6] ..... C11D 3/43; C11D 11/00; C11D 17/00

[52] U.S. Cl. ..... 510/365; 510/421; 510/423; 510/433; 510/416; 510/417; 510/500; 510/506

[58] Field of Search ..... 510/365, 421, 510/423, 433, 416, 417, 500, 506

[56] References Cited

U.S. PATENT DOCUMENTS

| | | | |
|---|---|---|---|
| T903,009 | 10/1972 | Katstra | 252/559 |
| 2,710,843 | 6/1955 | Stebleton | 252/153 |
| 2,901,433 | 8/1959 | Spring | 252/118 |
| 2,929,789 | 3/1960 | Pickett et al. | 252/153 |
| 2,958,593 | 11/1960 | Hoover et al. | 51/295 |

(List continued on next page.)

FOREIGN PATENT DOCUMENTS

| | | |
|---|---|---|
| 0 040 882 | 12/1981 | European Pat. Off. . |
| 0 130 786 A3 | 1/1985 | European Pat. Off. . |
| 0 666 308 A2 | 8/1995 | European Pat. Off. . |
| 1 061 718 | 4/1954 | France . |
| 1 207 745 | 2/1960 | France . |

(List continued on next page.)

OTHER PUBLICATIONS

"Cost Availability Safety Effectiveness", brochure of ARCO Chemical Company, 6 pgs, Sep. 1992.

"Ethers for Household and Institutional Products", brochure of Union Carbide Corporation, 14 pgs, Jul. 1976.

"Exxal 8 Alcohol", brochure of Exxon Chemical Company, 2 pgs, Sep. 1986.

"AO–14–2", brochure of Exxon Chemical Company, 2 pgs, Dec. 4, 1991.

"Non–Butyl Cleaners", brochure of Exxon Chemical Company, 2 pgs, Dec. 1980.

Morris et al., "Propylene–Based Glycol Ethers", *Household & Personal Products Industry*, pp. 48, 50, 52, 54 (May 1982).

"Solvent Formulations from Eastman Chemicals", brochure of Eastman Chemical Products, Inc., publication No. M–226, 4 pgs, Sep. 1983.

"Surfadone LP Speciality Solvents and Surfactants", brochure of International Specialty Products, publication No. 2302–243 5M–192, 7 pgs, 1992.

*The Merck Index, Tenth Edition*, pp. 870 and 1129–1130, 1983.

*CRC Handbook of Chemistry and Physics*; R.C. Weast et al., Eds.; CRC Press: Boca Raton, FL; pp. C–80, C–86, C–461, and C–479, undated.

1992 Formulary: A reference & Guide to Formulas for Metal Working/Cleaning, Transportation, and Household/Janitorial, brochure of Exxon Chemical Company, pp. 2, 5, 7, 10, 11, 12, and 14; Mar. 8, 1989.

Copy of International Search Report from International Application No. PCT/US97/18353, dated Jun. 5, 1998.

*Primary Examiner*—Ardith Hertzog
*Attorney, Agent, or Firm*—Michaele A. Hakamaki

[57] ABSTRACT

A composition capable of removing hydrophobic soils is provided that includes a nonionic surfactant; a very slightly water soluble organic solvent; water; and an optional additive. Improved hydrophobic soil removal is achieved wherein an amount of the slightly water soluble solvent with respect to an amount of the surfactant is sufficient to achieve a haze point in the composition.

24 Claims, 1 Drawing Sheet

U.S. PATENT DOCUMENTS

| | | | |
|---|---|---|---|
| 3,202,714 | 8/1965 | Zimmerer et al. | 260/584 |
| 3,367,878 | 2/1968 | Mankowich | 252/110 |
| 3,463,735 | 8/1969 | Stonebraker et al. | 252/137 |
| 3,553,144 | 1/1971 | Murphy | 252/158 |
| 3,615,827 | 10/1971 | Murphy | 134/38 |
| 3,634,338 | 1/1972 | Laugle et al. | 252/525 |
| 3,664,962 | 5/1972 | Kelly et al. | 252/125 |
| 3,696,043 | 10/1972 | Lebarge et al. | 252/153 |
| 3,806,460 | 4/1974 | Mukai et al. | 252/111 |
| 3,872,021 | 3/1975 | McKnight | 252/121 |
| 3,882,038 | 5/1975 | Clayton et al. | 252/164 |
| 3,917,850 | 11/1975 | Boucher | 424/333 |
| 3,928,249 | 12/1975 | Nunziata et al. | 252/526 |
| 3,939,090 | 2/1976 | Zmoda | 252/90 |
| 3,943,234 | 3/1976 | Roggenkamp | 424/343 |
| 3,948,819 | 4/1976 | Wilde | 252/545 |
| 4,013,607 | 3/1977 | Dwyer et al. | 260/29.6 H |
| 4,017,409 | 4/1977 | Demessemaekers et al. | 252/109 |
| 4,040,977 | 8/1977 | Eggensperger et al. | 252/401 |
| 4,144,201 | 3/1979 | Winterbotham et al. | 252/547 |
| 4,174,304 | 11/1979 | Flanagan | 252/524 |
| 4,175,062 | 11/1979 | Disch et al. | 252/540 |
| 4,203,872 | 5/1980 | Flanagan | 252/542 |
| 4,225,471 | 9/1980 | Claus et al. | 252/547 |
| 4,235,734 | 11/1980 | Scherubel | 252/142 |
| 4,240,919 | 12/1980 | Chapman | 252/95 |
| 4,254,104 | 3/1981 | Suzuki | 424/170 |
| 4,264,466 | 4/1981 | Carleton et al. | 252/99 |
| 4,264,729 | 4/1981 | Boljanski | 435/6 |
| 4,297,251 | 10/1981 | Bernardino | 252/545 |
| 4,348,292 | 9/1982 | Giam | 252/90 |
| 4,414,128 | 11/1983 | Goffinet | 252/111 |
| 4,460,374 | 7/1984 | Abel et al. | 8/501 |
| 4,501,680 | 2/1985 | Aszman et al. | 252/142 |
| 4,552,685 | 11/1985 | Kernstock et al. | 252/355 |
| 4,561,991 | 12/1985 | Herbots et al. | 252/118 |
| 4,587,030 | 5/1986 | Casey | 252/92 |
| 4,606,842 | 8/1986 | Keyes et al. | 252/174.23 |
| 4,606,850 | 8/1986 | Malik | 252/528 |
| 4,673,523 | 6/1987 | Smith et al. | 252/91 |
| 4,726,915 | 2/1988 | Verdicchio | 252/542 |
| 4,732,695 | 3/1988 | Francisco | 252/162 |
| 4,741,863 | 5/1988 | Yamamoto et al. | 252/547 |
| 4,749,508 | 6/1988 | Cockrell, Jr. et al. | 252/136 |
| 4,749,509 | 6/1988 | Kacher | 252/139 |
| 4,758,377 | 7/1988 | Iding | 252/556 |
| 4,767,563 | 8/1988 | de Buzzaccarial | 252/174.25 |
| 4,769,172 | 9/1988 | Siklosi | 252/153 |
| 4,776,974 | 10/1988 | Stanton et al. | 252/106 |
| 4,790,951 | 12/1988 | Frisser et al. | 252/162 |
| 4,814,109 | 3/1989 | Wittpenn, Jr. et al. | 252/547 |
| 4,857,114 | 8/1989 | Brumbaugh et al. | 134/42 |
| 4,863,629 | 9/1989 | Osberghaus et al. | 252/162 |
| 4,891,147 | 1/1990 | Gray et al. | 252/104 |
| 4,909,962 | 3/1990 | Clark | 252/547 |
| 4,927,556 | 5/1990 | Pokorny | 252/173 |
| 4,931,726 | 6/1990 | Kasukabe et al. | 324/158 F |
| 5,019,289 | 5/1991 | Gray et al. | 252/95 |
| 5,080,822 | 1/1992 | Van Eenam | 252/170 |
| 5,080,831 | 1/1992 | VanEenam | 252/558 |
| 5,093,031 | 3/1992 | Login et al. | 252/357 |
| 5,102,573 | 4/1992 | Han et al. | 252/153 |
| 5,126,068 | 6/1992 | Burke et al. | 252/174.21 |
| 5,158,710 | 10/1992 | VanEenam | 252/539 |
| 5,419,848 | 5/1995 | VanEenam | 252/164 |
| 5,435,934 | 7/1995 | Jon et al. | 252/117 |
| 5,503,778 | 4/1996 | Liu et al. | 252/542 |
| 5,523,024 | 6/1996 | Garabedian, Jr. et al. | 252/547 |
| 5,573,710 | 11/1996 | McDonell | 510/405 |
| 5,637,559 | 6/1997 | Koreltz et al. | 510/201 |

FOREIGN PATENT DOCUMENTS

| | | |
|---|---|---|
| 2 571 279 | 4/1986 | France . |
| 2 582 546 | 12/1986 | France . |
| 52-77111 | 5/1977 | Japan . |
| 54-14406 | 2/1979 | Japan . |
| 56-22397 | 3/1981 | Japan . |
| 57-28199 | 2/1982 | Japan . |
| 57-83598 | 5/1982 | Japan . |
| 58-185700 | 10/1983 | Japan . |
| 59-70652 | 4/1984 | Japan . |
| 95/2570 | 3/1995 | South Africa . |
| 782898 | 9/1957 | United Kingdom . |
| 1 602 234 | 11/1981 | United Kingdom . |
| 2 166 153 | 4/1986 | United Kingdom . |
| WO 91/00337 | 1/1991 | WIPO . |
| WO 91/09104 | 6/1991 | WIPO . |
| 94/22965 | 10/1994 | WIPO . |
| WO 94/22965 | 10/1994 | WIPO . |

AQUEOUS CLEANING COMPOSITION INCLUDING A NONIONIC SURFACTANT AND A VERY SLIGHTLY WATER-SOLUBLE ORGANIC SOLVENT SUITABLE FOR HYDROPHOBIC SOIL REMOVAL

FIELD OF THE INVENTION

The present invention relates to a cleaning composition for removing hydrophobic soil from a soiled surface and to a method for the use of such a composition.

BACKGROUND OF THE INVENTION

Chemical cleaners are a significant portion of the industrial cleaning market. A chemical cleaner is typically aqueous and comprises an organic solvent to solubilize various soils, a surfactant which serves as a wetting agent, and a builder which serves to chelate ions present in water, such as magnesium and calcium. The types and ratios of these ingredients can vary considerably depending on the types of soils to be cleaned and the performance desired. It is common that all components are water soluble. In some instances, however, particularly with the solvent ingredient, the water solubility can be negligible. In these cases, components commonly called "couplers" or "hydrotropes" are used to increase the apparent water solubility of the organic solvent in the cleaning composition. The amount of coupler required depends on the type of coupler, organic solvent, and the other components of the mixture. It is typically preferred to use the minimum amount of coupler necessary to completely solubilize the solvent, as this tends to reduce the cost of the cleaning composition.

For example, U.S. Pat. No. 5,080,831 (VanEenam), describe an aqueous cleaner which includes at least one sparingly water soluble organic solvent having water solubility of about 0.2 weight percent to about 6 weight percent, a solubilizing additive and water. The solubilizing additive is present in an amount to render the sparingly water soluble organic solvent to just completely water soluble so that the resulting aqueous solution is a true solution (i.e., a clear mixture exhibiting no Tyndall effect) rather than an emulsion or microemulsion.

An aqueous composition that is formulated as a microemulsion is described in U.S. Pat. No. 5,158,710 (VanEenam). The microemulsion includes at least one sparingly water soluble organic solvent having water solubility of about 0.2 weight percent to about 6 weight percent, a builder, a solubilizing additive, and water. In this composition, the solubilizing additive is present in an amount that does not substantially exceed the amount required to transform the combination of the organic solvent and the builder from a true macroemulsion to a microemulsion but less than the amount required to transform the microemulsion to a true solution, wherein the microemulsion is clear and exhibits a Tyndall effect.

An aqueous degreaser composition is described in U.S. Pat. No. 5,419,848 (VanEenam). The composition includes at least one sparingly water soluble organic solvent having water solubility of about 0.2 weight percent to about 6 weight percent, a viscosifying thickener, and water. A stable emulsion having a viscosity of at least about 500 centipoise and a droplet size of about 0.1 to 3 millimicrons is produced after subjecting the composition to energetic mixing and/or shear conditions. This relatively thick composition is typically used in lotions, creams, emollients, lubricants, humectants and skin conditioners that do not defat the skin.

SUMMARY OF THE INVENTION

In one embodiment, the present invention relates to a composition for removing hydrophobic soils. The composition preferably includes a nonionic surfactant, a very slightly water soluble organic solvent, water, and an optional additive. Preferably, the nonionic surfactant and the slightly water soluble solvent are each present in an amount sufficient to achieve a haze point in the composition. As used herein, "surfactant" means a substance which is able to reduce the surface tension of water. As used herein, "very slightly water soluble" means that the organic solvent has a water solubility ranging from about 0.01 weight percent to about 1.0 weight percent, more preferably ranging from about 0.01 weight percent to about 0.2 weight percent.

"Haze point," as used herein, means the first sign at which an aqueous composition of a nonionic surfactant titrated at room temperature with a very slightly water soluble organic solvent becomes semitransparent. The haze point is reached at that concentration when the clear solution of the nonionic surfactant transforms to a translucent (or hazy) mixture of the nonionic surfactant and the very slightly water soluble organic solvent. While not being bound by any particular theory, it is believed that the haze point is that point which a true solutionmicroemulsion becomes a macroemulsion. Preferably, the composition includes the slightly water soluble organic solvent and the nonionic surfactant in a weight ratio of the slightly water soluble organic solvent:the nonionic surfactant of about 0.3:1.0 to about 0.8:1.0.

Haze point is not intended to be synonymous with "cloud point." Typically, "cloud point" is understood to mean the temperature below which the composition exists as a clear, single phase solution and above which phase separation is observed, often by a cloudy appearance of the solution. Thus, the cloud point of a given solution is temperature dependent. In contrast, haze point is measured at ambient or room temperature (typically from about 20° C. to about 25° C.). At ambient temperature, the concentration of one of the components is varied. Thus, a composition can be characterized by a haze point that is dependent upon a concentration of one of the components or relative component ratio in the composition. A haze point of a particular composition can be determined using the Haze Point Determination Test, set forth as a Test Method herein.

Preferably, the slightly water soluble organic solvent is not a hydrocarbon or halocarbon, contains one or more of oxygen, nitrogen, sulfur, phosphorous containing functional groups and contains an alkyl group containing about 7 carbon atoms to about 16 carbon atoms. More preferably, the slightly water soluble organic solvent contains a moiety selected from the group of an alcohol, an aldehyde, a ketone, an ether, a glycol ether, an acid, an amine, an ester, an N-alkyl pyrrolidone, and a compatible mixture thereof.

Preferably, the nonionic surfactant is selected from the group of a branched or linear primary alcohol ethoxylate, a secondary alcohol ethoxylate, a branched decyltridecyl alcohol ethoxylate, a branched or linear alkylphenol ethoxylate, a branched or linear alkyl amine ethoxylate, an alkyl ether amine ethoxylate, a linear alcohol alkoxylate, and a mixture thereof. More preferably, suitable nonionic surfactants have an HLB value of about 7 to about 16.

Another embodiment of the invention is a method of removing hydrophobic soils from soiled surfaces comprising the steps of applying to a soiled surface an effective amount of the composition, as described above; and performing a mechanical operation on the surface with an abrasive article after applying the composition to the surface. An optional step of removing the composition from the surface may also be included in the method.

It was surprisingly and unexpectedly found that by adjusting the ratio of the slightly water soluble organic solvent relative to the nonionic surfactant to achieve the haze point of the composition, removal of hydrophobic soils was improved as shown by decreased soaking times required for soil removal demonstrated by the examples herein.

DESCRIPTION OF PREFERRED EMBODIMENTS

Figure 1:
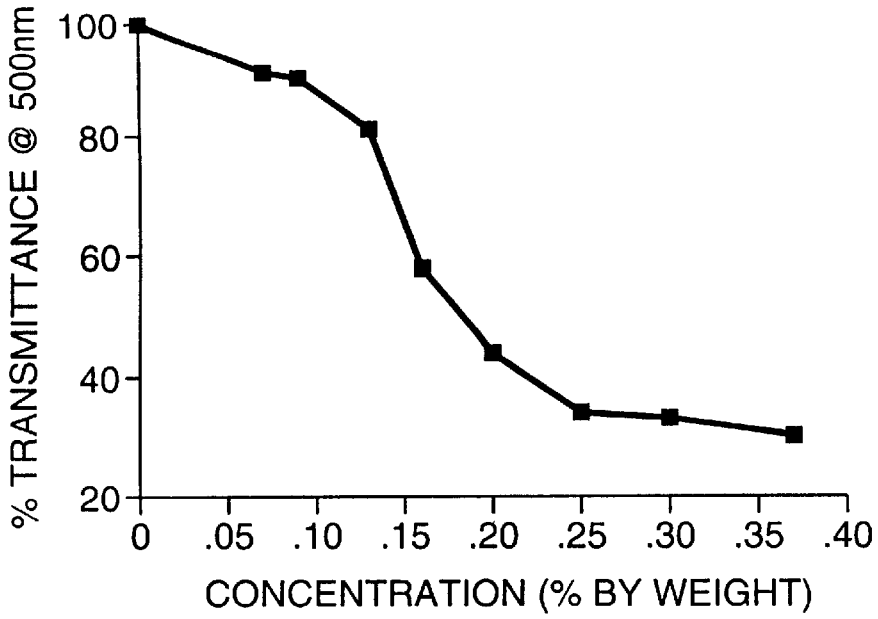
FIGS. 1 and 2 are a graphic representations of achieving a haze point of compositions in accordance with the invention.

A composition for removing hydrophobic soils in accordance with the invention preferably comprises a nonionic surfactant, a very slightly water soluble organic solvent, water, and, an optional additive. Preferably, the nonionic surfactant and the slightly water soluble solvent are each in an amount sufficient to achieve a haze point in the composition. At a ratio of the slightly water soluble organic solvent to the nonionic surfactant necessary to achieve the haze point, removal of hydrophobic soils improves as compared to compositions where the ratio of the slightly water soluble organic solvent to the nonionic surfactant is either above or below that necessary to achieve the haze point. This phenomenon may indicate improved cleansing properties of the composition of the invention.

Nonionic Surfactant

As previously noted, the surfactant serves the function of decreasing the surface tension of water within the compositions of the invention. Nonionic surfactants are a preferred class of surfactants useful in the hydrophobic soil removing compositions of the invention. Examples are nonionic surfactants formed by condensation of alkyl phenols, alkyl amines, or aliphatic alcohols with sufficient ethylene oxide, propylene oxide, or a combination thereof, to produce a compound having a polyoxyethylene and/or polyoxypropylene chain within the molecule, i.e., a chain composed of recurring ($—O—CH_2—CH_2—$) groups, or a chain composed of recurring ($—O—CH_2—CH—CH_3$) groups, or a combination thereof. Preferably, the nonionic surfactant is selected from the group of a branched or linear primary alcohol ethoxylate, a secondary alcohol ethoxylate, a branched decyltridecyl alcohol ethoxylate, a branched or linear alkylphenol ethoxylate, a branched or linear alkyl amine ethoxylate, an alkyl ether amine ethoxylate, a linear alcohol alkoxylate, and a mixture thereof. These nonionic surfactants preferably have an HLB value of about 7 to about 16. "HLB," as used herein, refers to an emulsification behavior of a surfactant as well as the relationship between hydrophilic and lipophilic portions of a molecule.

Such nonionic surfactants are commercially available and used for their detergent, surface active, wetting and emulsifying properties. One preferred nonionic surfactant used in the invention contains sufficient ethylene oxide units to insure solubility of the nonionic surfactant in the composition or in any dilution thereof which may be used in practice. One preferred group of nonionic surfactants includes from about 5 moles to about 40 moles of ethylene oxide per mole of nonionic surfactant, and more preferably about 5 moles to about 15 moles of ethylene oxide per mole of nonionic surfactant. Suitable nonionic surfactants include linear primary alcohol ethoxylates such as available under the trade designation of "NEODOL 91-6" (a $C_9$–$C_{11}$ alcohol having about 6 moles ethylene oxide per mole of linear primary alcohol ethoxylate) and "NEODOL 1-73B," (a $C_{11}$ alcohol with a blend of 7 moles and 3 moles of ethylene oxide per mole of linear primary alcohol ethoxylate) both are commercially available from Shell Oil Company, Houston, Tex.; ethoxylated tridecyl alcohols such as "ICONOL TDA8" (having 8 moles of ethylene oxide per mole of ethoxylated tridecyl alcohol), and "ICONOL TDA9" (having 9 moles of ethylene oxide per mole of ethoxylated tridecyl alcohol), "ICONOL DA9" (an ethoxylated decyl alcohol having 9 moles of ethylene oxide per mole of ethoxylated decyl alcohol) and "ICONOL OP10" (ethoxylated octylphenol having 10 moles of ethylene oxide per mole of ethoxylated octylphenol) all commercially available from BASF, Mount Olive, N.J.; "E14-5" (isodecyloxypropyl amine ethoxylate having 5 moles of ethylene oxide per mole of isodecyloxypropyl amine ethoxylate), commercially available from Tomah, Milton, Wis.; and "TRITON RW-75" (a $C_{12}$–$C_{14}$ amine ethoxylate having 9 moles of ethylene oxide per mole of amine ethoxylate), commercially available from Union Carbide, Little Fall, N.J. Another preferred group of nonionic surfactants includes "PLURAFAC D-25" and "PLURAFAC RA-40," both being modified oxyethylated straight chain alcohol and are commercially available from BASF, Mount Olive, N.J., to name a few.

The weight percent of the surfactant typically ranges from about 0.1 to about 1.0 weight percent in ready-to-use formulations, with amounts of the surfactant greater than about 1.0 weight percent being uneconomical and not typically rendering a more beneficial wetting property. If the amount of nonionic surfactant is below about 0.1 weight percent, insufficient wetting of the hydrophobic soil-covered surface may be noticed, but this is not necessarily considered outside of the invention.

Slightly Water Soluble Organic Solvent

The slightly water soluble organic solvent used in the compositions of the invention serves to promote fast drying properties of the compositions, and to solubilize organic materials in hydrophobic soils.

As used herein the term "very slightly water-soluble" means that the organic solvent has a water solubility ranging from about 0.01 weight percent to about 1.0 weight percent, more preferably ranging from about 0.01 weight percent to about 0.2 weight percent at about 20° C. Preferably, the slightly water soluble organic solvent is not a hydrocarbon or halocarbon, contains one or more of oxygen, nitrogen, sulfur, phosphorous containing functional groups and contains an alkyl group containing about 7 carbon atoms to about 16 carbon atoms. More preferably, the slightly water soluble organic solvent contains a moiety selected from the group of an alcohol, an aldehyde, a ketone, an ether, a glycol ether, an acid, an amine, an ester, a pyrrolidone, and a compatible mixture thereof.

Such slightly water soluble organic solvents are commercially available. For example, one preferred slightly water soluble organic solvent is an N-octyl pyrrolidone, available under the trade designation "SURFADONE" LP-100 from International Specialty Products, Wayne, N.J., having a maximum solubility in water of about 0.124 weight percent.

Other preferred slightly water soluble organic solvents include other commercially available materials available under the trade designation "EEH," (ethylene glycol, ethyl hexyl ether having a water solubility of about 0.1 weight percent) and "EH" (2-ethyl hexanol having a water solubility of about 0.1 weight percent), both commercially available from Eastman Chemical, Kingsport, Tenn.; and "EXXAL-8" (isooctyl alcohol having a water solubility of about 0.06 weight percent), commercially available from Exxon, Houston, Tex. Others include 1-octanol having a water solubility of about 0.1 weight percent and di-isobutyl ketone having a water solubility of about 0.05 weight percent, both commercially available from Aldrich Chemicals, Milwaukee, Wis.

Optional Additives

The compositions of the invention may contain other optional but conventional additives. For example, the composition according to the invention may contain a coupler, typically of low molecular weight (less than 500), which has as its primary function the ability to substantially completely solubilize the organic solvents useful in the compositions of the invention.

Couplers may also have surfactant properties. This however is not their primary function. The term "hydrotrope" is also sometimes used to describe coupling chemicals, and the terms "coupler" and "hydrotrope" are used interchangeably herein. A suitable coupler that may optionally be included in the composition of the invention is preferably selected from the group of isopropyl alcohol, DPM (dipropylene glycol monomethyl ether), propyl glycol n-butyl ether, dipropylene glycol n-butyl ether, and a mixture thereof.

The compositions may also contain a colorant to provide a more aesthetic appearance, a fragrance to provide more acceptable smell, a preservative to prevent bacterial growth in the solution, a suitable anti-microbial agent or bacteriostat to eradicate germs, mold, mildew, and the like, foaming or anti-foaming agents, film-forming agents, and the like.

Further, it may be advantageous to include a compatible thickening agent to render the viscosity of the compositions of the invention such that they may be applied to a vertical surface, e.g., a base board, and not run therefrom. If such running occurs, the residence time of the composition with respect to the surface being cleaned would be reduced. Alternatively, the composition may run onto areas where it is not wanted.

In use, the compositions of the invention may be sprayed as an aerosol or non-aerosol upon the surface to be cleaned, or simply poured thereon. Spraying can be accomplished by conventional mechanical spraying devices or by using an aerosol dispensing container with a sufficient amount of suitable aerosol propellant such as a low boiling alkanes or mixtures thereof, such as a mixture isobutane and propane.

Methods of Cleaning Surfaces Using the Compositions of the Invention

The compositions of the invention may be applied to a soiled surface in concentrated or ready-to-use (rtu) form as desired. Performing a mechanical operation to the soiled surface after application of a composition of the invention may be desired or required for hydrophobic soil removal. Performing a mechanical operation may include wiping, abrading, scrubbing, brushing, and the like. However, if the underlying surface is soft and/or decorative, abrading or scrubbing may not be desirable. An abrasive article that may be used includes, for example, a porous sponge material, or nonwoven or woven article. One preferred nonwoven material is that known under the trade designation "SCOTCH-BRITE," from Minnesota Mining and Manufacturing Company (3M), St. Paul, Minn. Such nonwoven products and their manufacture are described in U.S. Pat. No. 2,958,593 (Hoover et al.). After performing a mechanical operation on the surface, the composition is preferably removed. This can be accomplished by a variety of techniques that are generally known, including, for example, rinsing the composition from the surface.

EXAMPLES

The compositions and methods of the invention are further described in the following Test Methods and Examples, wherein all parts and percentages are by weight unless otherwise specified.

Test Methods

Haze Point Determination Test

Into a 150 ml glass beaker, a desired amount, typically about 0.1 gm to about 0.5 gm, of nonionic surfactant was weighed to an accuracy of 0.01 gm on a standard top loading balance. Water was added so that the weight of the aqueous solution of nonionic surfactant was 100 gm total. The beaker containing the aqueous solution of nonionic surfactant was placed on a standard laboratory magnetic stir plate. The solution was stirred with a magnetic stir bar until the solution was clear. The stirring operation did not entrap air or produce foaming of the mixture. A slightly water soluble organic solvent was added dropwise until the solution turned slightly hazy, by visual examination. The beaker was removed from the magnetic stir plate and placed on a standard light box containing a 52 watt/120 volt light bulb. The light box also had a mask of black paper surrounding the four vertical surfaces. The entire top surface of the light box was covered with white bond paper bearing printed alpha-numeric characters of 9 point type and black in color.

The light in the light box was turned on. From the top surface of the solution, the alpha-numeric characters were viewed through the solution. The haze point was determined by observation of whether the characters were legible or totally obscured. If the characters remained legible, the beaker was replaced on the magnetic stir plate and more slightly water soluble organic solvent was added dropwise and character observation on the light box was repeated. The beaker was weighed and the initial weight was subtracted from the final weight. That weight difference was the amount of the slightly water soluble organic solvent that was added to reach the haze point. However, if the characters were totally obscured, that is, printed characters of any type cannot be discerned, then the slightly water soluble organic solvent was determined to be in excess and the entire process would need to be repeated. In other words, the haze point was determined at that instant where the printed characters are still visible but that the exact nature of each individual character could not be readily discerned while viewing the characters through the solution on the light box.

Hydrophobic Soil Removal Test

In the hydrophobic soil removal tests, a hydrophobic soil solution consisting of equal amounts of soy bean oil and lard dissolved in enough methylene chloride to form a solution was prepared. A small amount of oil blue pigment for visualization was added to the solution. 25 millimeter (mm)×75 mm glass slides were then immersed for a few seconds into the hydrophobic soil and drawn up quickly so that the hydrophobic soil coated both sides of the slide (25 mm×30 mm on each side). The hydrophobic soil-coated slides were then dried by hanging at room temperature (about 20° C.) for at least 16 hours.

In the hydrophobic soil removal test, 140 milliliters (ml) of composition to be tested was placed into a 150 ml glass beaker equipped with a magnetic stir bar (2.54 cm in length). The beaker was then placed on a magnetic stirrer (Barnant Co. model no. 700–5011). The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The magnetic stirrer was immediately turned on and the stirring power adjusted to 2000 rpm with a strobe light. The composition was stirred for five minutes, after which the % removal of hydrophobic soil was measured visually for each side of the slide. Slides were not reused.

Materials Description

The materials utilized to prepare compositions evaluated in the following examples are summarized in Table 1, below.

TABLE 1

| *Surfactants* | Supplier | *Slightly water soluble solvent* | Supplier | *Coupler* | Supplier |
|---|---|---|---|---|---|
| ICONOL TDA9 | BASF/ Mount Olive,NJ | EEH[1] | Eastman/ Kingsport,TN | DPM[4] | Dow/Midland, MI |
| ICONOL TDA8 | BASF/ Mount Olive,NJ | EXXAL 8[2] | Exxon/ Houston,TX | IPA[5] | Milsolv Co/ Butler,WI |
| ICONOL DA9 | BASF/ Mount Olive,NJ | SURFADONE LP100 | ISP/Lombard, IL | | |
| NEODOL 1-73B | Shell/ Houston,TX | EH[3] | Eastman / Kingsport,TN | | |
| NEODOL 91-6 | Shell/ Houston,TX | D-LIMONENE | Florida Co / Miami,FL | | |
| ICONOL OP-10 | BASF/ Mount Olive,NJ | DOWANOL PnB | Dow/Midland, MI | | |
| E14-5 | Tomah/Milton,WI | 1-Octanol | Aldrich/ Milwaukee,WI | | |
| TRITON RW-75 | Union Carbide/ Little Fall,NJ | Di-isobutyl ketone | Aldrich/ Milwaukee,WI | | |
| PLURAFAC D-25 | BASF/ Mount Olive,NJ | | | | |
| PLURAFAC RA-40 | BASF/ Mount Olive,NJ | | | | |

[1]Ethylene glycol, ethyl hexyl ether
[2]Isooctyl alcohol
[3]2-ethyl hexanol
[4]Dipropylene glycol monomethyl ether
[5]Isopropyl alcohol

Example 1 and Comparative Examples A–E

The compositions of Example 1 and Comparative examples A–E are provided in Table 2. Comparative examples A and B were formulated to include only a slightly water soluble organic solvent (Comparative example A) or a surfactant (Comparative example B). Comparative example C was formulated to include a surfactant and a slightly water soluble organic solvent, wherein the slightly water soluble organic solvent was present in an amount just below the amount necessary to reach the haze point, i.e., the composition appeared clear so that the characters were readily discernible when the composition was evaluated by the Haze Point Determination Test, as described above. Comparative examples D and E were formulated to include a slightly water soluble organic solvent in an amount above the amount necessary to reach the haze point, i.e., the compositions appeared cloudy and the presence of the characters could not be determined when the compositions were evaluated by the Haze Point Determination Test.

These compositions were subjected to the Hydrophobic Soil Removal Test, as described above. These results are shown in Table 3. The data in Table 3 demonstrated that there appeared to be a synergistic effect of the slightly water soluble organic solvent and the nonionic surfactant at a ratio to just below the haze point as shown by Comparative example C. However, unexpectedly it was observed that by increasing the ratio the slightly water soluble organic solvent to the nonionic surfactant so that the haze point is reached, the cleaning effect of the composition remarkably improved, as shown by Example 1. Comparative examples D and E demonstrated that when the ratio of the slightly water soluble organic solvent to the nonionic surfactant was increased to well above the haze point, no further cleaning improvement was observed.

A determination of the haze point was confirmed by a spectrophotometric analysis of a composition having increasing amounts of the slightly water soluble organic solvent added to an aqueous solution of a surfactant, represented by Example 1.

An aqueous solution of 0.35% by weight of a surfactant (ICONOL TDA9) and 0.14% by weight of isopropyl alcohol was prepared and stirred until clear. An aliquot of 4 gm was transferred from the solution to disposable polystyrene cuvette, available from Fisher Scientific. The percent transmittance was measured using a UVIKON 941 spectrophotometer, available from Kontron Instruments, San Diego, Calif., at 500 nm wavelength. After the transmittance was recorded, the aliquot was decanted back into the solution. The slightly water soluble organic solvent (EEH) was added two drops at per interval, i.e., when the percent transmittance was determined after the two drop addition of the slightly water soluble organic solvent.

The percent transmittance (% transmittance at 500 nm) was plotted against the concentration of the slightly water soluble organic solvent (concentration % by weight). FIG. 1 shows the results for increasing amounts of EEH, as illustrated by Example 1 (at the haze point). It appears that the haze point can be determined graphically by drawing a line tangent to the part of the titration curve showing the greatest decrease in percent transmittance. A line can then be drawn tangent to the lower end asymptotic part of the curve. The amount of slightly water soluble organic solvent necessary to achieve a haze point for a given nonionic surfactant appears to be the concentration at the intersection of these two tangent lines (not shown).

TABLE 2

| Example No.: | Comp. Ex. A | Comp. Ex. B | Comp. Ex. C | 1 | Comp. Ex. D | Comp. Ex. E |
|---|---|---|---|---|---|---|
| Surfactants | | | | | | |
| ICONOL TDA9 | — | 0.35 | 0.35 | 0.35 | 0.35 | 0.35 |
| ICONOL TDA8 | | | | | | |
| ICONOL DA9 | | | | | | |
| NEODOL 1-73B | | | | | | |
| NEODOL 91-6 | | | | | | |
| ICONOL OP-10 | | | | | | |
| E14-5 | | | | | | |
| TRITON RW-75 | | | | | | |
| Slightly water soluble solvent | | | | | | |
| EEH | 0.13 | — | 0.13 | 0.25 | 0.37 | 0.5 |
| Coupler | | | | | | |
| IPA | 0.14 | 0.14 | 0.14 | 0.14 | 0.14 | 0.14 |
| DI water | balance | balance | balance | balance | balance | balance |
| solvent/ surfactant ratio | | | 0.37 | 0.71 | 1.06 | 1.43 |
| Dilution Ratio | rtu | rtu | rtu | rtu | rtu | rtu |
| Clarity of rtu | clear | clear | clear | hazy | cloudy | cloudy |

TABLE 3

| | Hydrophobic Soil Removal Rate (%) | | | | | |
|---|---|---|---|---|---|---|
| Example No.: | Comp. Ex. A | Comp. Ex. B | Comp. Ex. C | 1 | Comp. Ex. D | Comp. Ex. E |
| 1 Min | 0 | 0 | 5 | 20 | 15 | 5 |
| 2 min | 0 | 10 | 40 | 70 | 20 | 30 |
| 3 min | 0 | 20 | 70 | 95 | 80 | 60 |
| 4 min | 0 | 30 | 95 | | | |
| 5 min | 0 | 35 | | | | |

Examples 2–8 and Comparative Examples F and G

The compositions of Examples 2–8 and Comparative examples F and G are provided in Table 4. These examples varied the surfactant and the slightly water soluble organic solvent. Examples 2 and 3 included a slightly water soluble organic solvent having a water solubility of about 0.06% as compared to about 0.1% used in Examples 1 and 2. Example 5 included a slightly water soluble organic solvent having a water solubility of about 0.124%.

These compositions were subjected to the Hydrophobic Soil Removal Test, as described above. These results are shown in Table 5.

A determination of the haze point was confirmed by a spectrophotometric analysis of a composition having increasing amounts of the slightly water soluble organic solvent added to an aqueous solution of a surfactant, represented by Example 8.

An aqueous solution of 0.35% by weight of a surfactant (NEODOL 91-6) and 0.14% by weight of isopropyl alcohol was prepared and stirred until clear. An aliquot of 4 gm was transferred from the solution to disposable polystyrene cuvette, available from Fisher Scientific. The percent transmittance was measured using a UVIKON 941 spectrophotometer, available from Kontron Instruments, San Diego, Calif., at 500 nm wavelength. After the transmittance was recorded, the aliquot was decanted back into the solution. The slightly water soluble organic solvent (EEH) was added two drops at per interval, i.e., when the percent transmittance was determined after the two drop addition of the slightly water soluble organic solvent.

Figure 2:
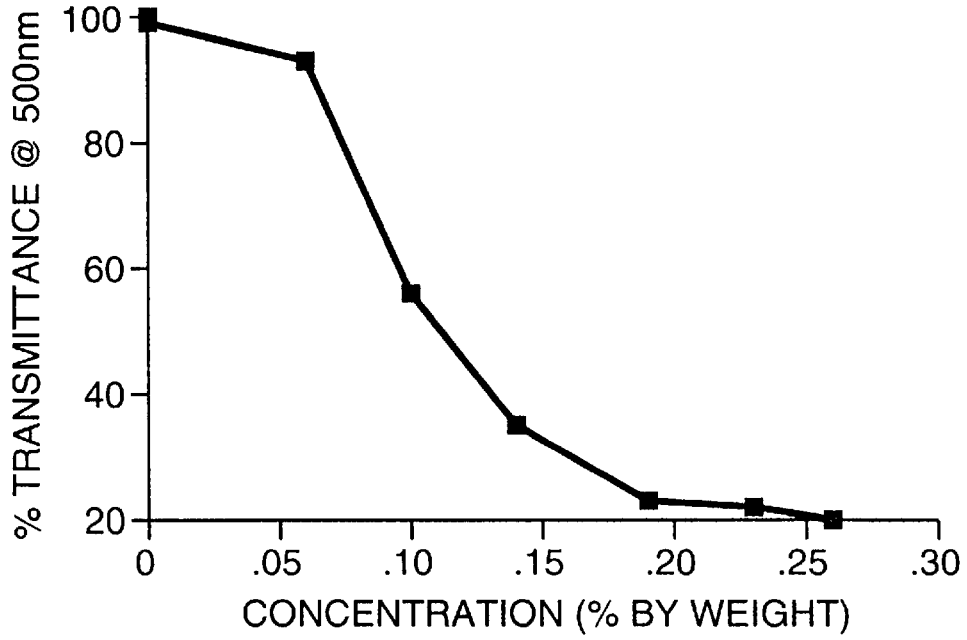

The percent transmittance (% transmittance at 500 nm) was plotted against the concentration of the slightly water soluble organic solvent (concentration % by weight). FIG. 2 shows the results for increasing amounts of EEH, as illustrated by Example 8 (at the haze point). It appears that the haze point can be determined graphically by drawing a line tangent to the part of the titration curve showing the greatest decrease in percent transmittance. A line can then be drawn tangent to the lower end asymptotic part of the curve. The amount of slightly water soluble organic solvent necessary to achieve a haze point for a given nonionic surfactant appears to be the concentration at the intersection of these two tangent lines (not shown).

TABLE 4

| Example No.: | 2 | Comp. Ex. F | Comp. Ex. G | 3 | 4 | 5 | 6 | 7 | 8 |
|---|---|---|---|---|---|---|---|---|---|
| Surfactants | | | | | | | | | |
| ICONOL TDA9 | 0.35 | | | | | | | | |
| ICONOL TDA8 | | 0.35 | — | 0.35 | 0.35 | 0.35 | | | |
| ICONOL DA9 | | | | | | | 0.35 | | |
| NEODOL 1-73B | | | | | | | | 0.35 | |
| NEODOL 91-6 | | | | | | | | | 0.35 |
| ICONOL OP-10 | | | | | | | | | |
| E14-5 | | | | | | | | | |
| TRITON RW-75 | | | | | | | | | |
| Slightly Water Soluble Solvent | | | | | | | | | |
| EEH | | | | | 0.18 | | 0.14 | 0.11 | 0.14 |
| EXXAL 8 | 0.14 | — | 0.09 | 0.09 | | | | | |
| SURFADONE LP100 | | | | | | 0.29 | | | |

TABLE 4-continued

| Example No.: | 2 | Comp. Ex. F | Comp. Ex. G | 3 | 4 | 5 | 6 | 7 | 8 |
|---|---|---|---|---|---|---|---|---|---|
| Coupler | | | | | | | | | |
| IPA | 0.14 | 0.14 | 0.14 | 0.14 | 0.14 | 0.14 | 0.14 | 0.14 | 0.14 |
| DI water | balance | balance | balance | balance | balance | balance | balance | balance | balance |
| solvent/surfactant ratio | 0.4 | | | 0.26 | 0.51 | 0.83 | 0.4 | 0.31 | 0.4 |
| Dilution Ratio | rtu | rtu | rtu | rtu | rtu | rtu | rtu | rtu | rtu |
| Clarity of rtu | hazy | clear | slightly cloudy | hazy | hazy | hazy | hazy | hazy | hazy |

TABLE 5

Hydrophobic Soil Removal Rate (%)

| Example No.: | 2 | Comp. Ex. F | Comp. Ex. G | 3 | 4 | 5 | 6 | 7 | 8 |
|---|---|---|---|---|---|---|---|---|---|
| 1 Min | 20 | 0 | 0 | 20 | 30 | 20 | 20 | 20 | 20 |
| 2 min | 60 | 10 | 5 | 80 | 70 | 80 | 50 | 35 | 40 |
| 3 min | 95 | 25 | 5 | >95 | 95 | >95 | 80 | 70 | 80 |
| 4 min | | | | | | | | 95 | 90 |
| 5 min | | | | | | | | | |

Examples 9–12

The compositions in Examples 9–12 are provided in Table 6. These concentrated compositions were formulated by increasing the amounts of the components determined to achieve the haze point by multiplying by the desired end dilution factor. Thus, when these concentrated compositions were diluted, the haze point was achieved.

These compositions were subjected to the Hydrophobic Soil Removal Test, as described above, after dilution with water at the ratio shown in Table 6. These results are shown in Table 7. The results demonstrated that the composition of the invention can be prepared as a concentrate, subsequently diluted with water and will still performed equivalently to the ready-to-use compositions that did not require dilution prior to use.

TABLE 6

| Example No.: | 9 | 10 | 11 | 12 |
|---|---|---|---|---|
| *Surfactant* | | | | |
| ICONOL TDA9 | 64.8 | 64.8 | 64.8 | 61.83 |
| ICONOL TDA8 | | | | |
| ICONOL DA9 | | | | |
| NEODOL 1-73B | | | | |
| NEODOL 91-6 | | | | |
| ICONOL OP-10 | | | | |
| E14-5 | | | | |
| TRITON RW-75 | | | | |
| *Slightly Water Soluble Solvent* | | | | |
| EEH | 25.9 | | | |
| EXXAL 8 | | | 15.54 | |
| SURFADONE LP100 | | | | 33.6 |
| EH | | 25.9 | | |
| *DI water* | 9 | 9 | 19.66 | 46 |
| *solvent/surfactant ratio* | 0.4 | 0.4 | 0.24 | 0.54 |
| *Dilution Ratio* | 1/259 | 1/259 | 1/259 | 1/239 |
| *Clarity of rtu* | hazy | hazy | hazy | hazy |

TABLE 7

Hydrophobic Soil Removal Rate (%)

| Example No: | 9 | 10 | 11 | 12 |
|---|---|---|---|---|
| 1 Min | 40 | 60 | 60 | 80 |
| 2 min | 90 | 90 | 90 | 95 |
| 3 min | | | | |
| 4 min | | | | |
| 5 min | | | | |

Examples 13–17 and Comparative Examples H and I

The compositions in Examples 13–17 were formulated using varied combinations of a nonionic surfactant and a slightly water soluble organic solvent. Comparative example H was formulated using an organic solvent known to have a water solubility of zero. Comparative example I was formulated using an organic solvent known to have a water solubility of about 5.6%.

TABLE 8

| Example No.: | Comp. Ex. H | Comp. Ex. I | 13 | 14 | 15 | 16 | 17 |
|---|---|---|---|---|---|---|---|
| *Surfactant* | | | | | | | |
| ICONOL TDA9 | 0.35 | 0.35 | 0.35 | | | | 0.35 |
| ICONOL TDA8 | | | | | | | |
| ICONOL DA9 | | | | | | | |
| NEODOL 1-73B | | | | | | | |
| NEODOL 91-6 | | | | | | | |
| ICONOL OP-10 | | | | 0.35 | | | |
| E14-5 | | | | | 0.35 | | |
| TRITON RW-75 | | | | | | 0.35 | |
| *Slightly Water Soluble Solvent* | | | | | | | |
| EEH | | | | 0.15 | 0.17 | 0.13 | |
| EXXAL 8 | | | | | | | |
| SURFADONE LP100 | | | | | | | |
| EH | | | | | | | |
| D-LIMONENE | 0.05 | | | | | | |
| DOWANOL PnB | | 6.1 | | | | | |
| 1-Octanol | | | 0.17 | | | | |
| Di-isobutyl ketone | | | | | | | 0.15 |
| *Coupler* | | | | | | | |
| IPA | 0.14 | 0.14 | 0.14 | 0.14 | 0.15 | 0.15 | 0.2 |
| *DI water* | balance | balance | balance | balance | balance | balance | balance |
| *solvent/surfactant ratio* | 0.14 | 17.4 | 0.49 | 0.43 | 0.49 | 0.37 | 0.43 |

TABLE 8-continued

| Example No.: | Comp. Ex. H | Comp. Ex. I | 13 | 14 | 15 | 16 | 17 |
|---|---|---|---|---|---|---|---|
| *Dilution Ratio* | rtu | rtu | rtu | rtu | rtu | rtu | rtu |
| *Clarity of rtu* | cloudy/ droplets | cloudy | hazy | hazy | hazy | hazy | hazy |

TABLE 9

Hydrophobic Soil Removal Rate (%)

| Example No.: | Comp. Ex. H | Comp. Ex. I | 13 | 14 | 15 | 16 | 17 |
|---|---|---|---|---|---|---|---|
| 1 Min | 0 | 5 | 30 | 80 | 70 | 20 | 40 |
| 2 min | 5 | 30 | 60 | 95 | 95 | 40 | 90 |
| 3 min | 20 | 60 | 90 | | | 60 | |
| 4 min | 35 | 80 | | | | 80 | |
| 5 min | | >95 | | | | 95 | |

Examples 18–19 and Comparative Examples J and K

The previous 17 examples all utilized a nonionic surfactant that consisted of ethylene oxide-containing nonionic surfactants. Examples 18 and 19 were formulated utilizing propylene oxide-containing nonionic surfactants and a slightly water soluble organic solvent present in an amount to achieve the haze point of the composition. In particular, Example 18 contained a $C_{12}$–$C_{16}$ alcohol having random ethyoxylate/propoxlyate units, wherein the composition was formulated at its haze point. Comparative example J contained the same surfactant as in Example 18 but was formulated below the haze point. Example 19 contained a linear alcohol having block ethoxylate/propoxylate units, wherein the composition was formulated at its haze point. Comparative example K contained the same surfactant as in Example 19 but was formulated below the haze point. The formulations for Examples 18 and 19 and Comparative examples J and K are shown in Table 10, below.

These compositions were subjected to the Hydrophobic Soil Removal Test, as described above. The results are shown in Table 11. The results show that improved cleaning capability is observed when the composition is formulated to achieve its haze point as compared to a composition that included both the nonionic surfactant and the slightly water soluble organic solvent but formulated below its haze point thus, confirming the trend observed in Examples 1–17.

However, it was observed that the compositions in Examples 18 and 19 appeared to separate or settle out over time. It is believed that with the addition of a thickener, the composition would stabilize so that separation or settling would not occur.

TABLE 10

| Example No.: | Comp. Ex. J | Comp. Ex. K | 18 | 19 |
|---|---|---|---|---|
| *Surfactant* | | | | |
| PLURAFAC D-25 | 0.49 | | 0.49 | |
| PLURAFAC RA-40 | | 0.49 | | 0.49 |

TABLE 10-continued

| Example No.: | Comp. Ex. J | Comp. Ex. K | 18 | 19 |
|---|---|---|---|---|
| *Slightly Water Soluble Solvent* | | | | |
| EEH | 0.2 | 0.15 | 0.38 | 0.4 |
| *Coupler* | | | | |
| IPA | 0.2 | 0.2 | 0.2 | 0.2 |
| *DI water* | balance | balance | balance | balance |
| *solvent/surfactant ratio* | 0.4 | 0.31 | 0.78 | 0.62 |
| *Dilution Ratio* | rtu | rtu | rtu | rtu |
| *Clarity of rtu* | clear | clear | hazy | hazy |

TABLE 11

Hydrophobic Soil Removal Rate (%)

| Example No.: | Comp. Ex. J | Comp. Ex. K | 18 | 19 |
|---|---|---|---|---|
| 1 Min | 5 | 0 | 5 | 5 |
| 2 min | 15 | 5 | 30 | 30 |
| 3 min | 20 | 20 | 60 | 70 |
| 4 min | 30 | 30 | 90 | 90 |
| 5 min | 40 | 35 | | |

It is to be understood that the above description is intended to be illustrative, and not restrictive. Various modifications and alterations of this invention will become apparent to those skilled in the art from the foregoing description without departing from the scope and the spirit of this invention. It should be understood that this invention is not to be unduly limited to the illustrative embodiments set forth herein.

What is claimed is:

1. A composition for removing hydrophobic soils comprising:

a nonionic surfactant;

a very slightly water soluble organic solvent;

water; and an optional additive; wherein the nonionic surfactant and the slightly water soluble solvent are each in an amount sufficient to achieve a haze point in the composition such that the composition of the nonionic surfactant titrated with the very slightly water soluble organic solvent becomes semitransparent at room temperature.

2. The composition of claim 1 wherein the slightly water soluble organic solvent is not a hydrocarbon or halocarbon, contains one or more heteroatoms of oxygen, nitrogen, sulfur, phosphorous containing functional groups and contains an alkyl group containing about 7 carbon atoms to about 16 carbon atoms.

3. The composition of claim 2 wherein the slightly water soluble organic solvent contains a moiety selected from the group consisting of an alcohol, an aldehyde, a ketone, an ether, a glycol ether, an acid, an amine, an ester, an N-alkyl pyrrolidone, and a compatible mixture thereof.

4. The composition of claim 1 wherein the nonionic surfactant is selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a linear alcohol alkoxylate, and a mixture thereof.

5. The composition of claim 4 wherein the nonionic surfactant has an HLB value of about 7 to about 16.

6. The composition of claim 1 wherein the optional additive is selected from the group consisting of a coupler, a colorant, a fragrance, a preservative, an anti-microbial agent, a foaming agent, an anti-foaming agent, a film-forming agent, a thickener, and a mixture thereof.

7. The composition of claim 6 wherein the coupler is selected from the group consisting of isopropyl alcohol, dipropylene glycol monomethyl ether, propyl glycol n-butyl ether, dipropylene glycol n-butyl ether, and a mixture thereof.

8. The composition of claim 1 wherein the slightly water soluble organic solvent has a water solubility from about 0.01% by weight to about 0.2% by weight.

9. The composition of claim 1 wherein the slightly water soluble organic solvent and the nonionic surfactant are present in a weight ratio of the slightly water soluble organic solvent: the nonionic surfactant of about 0.3:1.0 to about 0.8:1.0.

10. A composition for removing hydrophobic soils comprising:

a nonionic surfactant;

a very slightly water soluble organic solvent having a water solubility from about 0.01% by weight to about 1.0 weight percent; and water; wherein the nonionic surfactant and the slightly water soluble solvent are each in an amount sufficient to achieve a haze point in the composition such that the composition becomes semitransparent at room temperature.

11. A composition suitable for removing hydrophobic soils from a surface, wherein the composition is formed by titrating a nonionic surfactant with a very slightly water soluble organic solvent;

water; and an optional additive; wherein the nonionic surfactant and the slightly water soluble solvent are each in an amount sufficient to achieve a haze point in the composition.

12. The composition of claim 11 wherein the slightly water soluble organic solvent is not a hydrocarbon or halocarbon, contains one or more of oxygen, nitrogen, sulfur, phosphorus containing functional groups and contains an alkyl group containing about 7 carbon atoms to about 16 carbon atoms.

13. The composition of claim 12 wherein the slightly water soluble organic solvent contains a moiety selected from the group consisting of an alcohol, an aldehyde, a ketone, an ether, a glycol ether, an acid, an amine, an ester, an N-alkyl pyrrolidone, and a compatible mixture thereof.

14. The composition of claim 11 wherein the nonionic surfactant is selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a linear alcohol alkoxylate, and a mixture thereof.

15. The composition of claim 14 wherein the nonionic surfactant has an HLB value of about 7 to about 16.

16. The composition of claim 11 wherein the optional additive is selected from the group consisting of a coupler, a colorant, a fragrance, a preservative, an anti-microbial agent, a foaming agent, an anti-foaming agent, a film-forming agent, a thickener, and a mixture thereof.

17. The composition of claim 16 wherein the coupler is selected from the group consisting of isopropyl alcohol, dipropylene glycol monomethyl ether, propyl glycol n-butyl ether, dipropylene glycol n-butyl ether, and a mixture thereof.

18. The composition of claim 11 wherein the slightly water soluble organic solvent has a water solubility from about 0.01% by weight to about 0.2% by weight.

19. The composition of claim 11 wherein the slightly water soluble organic solvent and the nonionic surfactant are present in a weight ratio of the slightly water soluble organic solvent:the nonionic surfactant of about 0.3:1.0 to about 0.8:1.0.

20. A composition suitable for removing hydrophobic soils from a surface, wherein the composition is formed by combining a nonionic surfactant;

a very slightly water soluble organic solvent having a water solubility from about 0.01% by weight to about 1.0 weight percent; and water; wherein the nonionic surfactant and the slightly water soluble solvent are each in an amount sufficient to achieve a haze point in the composition.

21. A method of removing hydrophobic soils from soiled surfaces comprising the steps of:

applying to a soiled surface an effective amount of the composition of claim 1; and performing a mechanical operation on the surface with an abrasive article after applying the composition to the surface.

22. The method of claim 21, further comprising the step of removing the composition from the surface after the performing a mechanical operation step.

23. A method of removing hydrophobic soils from soiled surfaces comprising the steps of:

applying to a soiled surface an effective amount of the composition of claim 11; and performing a mechanical operation on the surface with an abrasive article after applying the composition to the surface.

24. The method of claim 23 further comprising the step of removing the composition from the surface after the performing a mechanical operation step.

* * * * *

UNITED STATES PATENT AND TRADEMARK OFFICE

CERTIFICATE OF CORRECTION

PATENT NO. : 5,922,665
DATED : July 13, 1999
INVENTOR(S) : Augustine Liu

It is certified that error appears in the above-identified patent and that said Letters Patent is hereby corrected as shown below:

Column 2,
Line 21, "solutionmicroemulsion" should read -- solution/microemulsion --.
Line 52, "decyltridecyl" should read -- decyl/tridecyl --.

Column 3,
Line 45, "decyltridecyl" should read -- decyl/tridecyl --.

Column 12,
Line 64, Table 6, Dl water row, "46" should read -- 4.6 --.

Column 15,
Line 43, Claim 12, after "more" please add -- heteroatoms --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*